US010107154B2

(12) United States Patent
Pluta et al.

(10) Patent No.: US 10,107,154 B2
(45) Date of Patent: Oct. 23, 2018

(54) ELECTRIC CAM PHASER WITH FIXED SUN PLANETARY

(71) Applicant: BorgWarner Inc., Auburn Hills, MI (US)

(72) Inventors: Christopher J. Pluta, Lansing, NY (US); Michael Marsh, Dryden, NY (US); Michael Grieb, Marallus, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 28 days.

(21) Appl. No.: 15/315,871

(22) PCT Filed: May 29, 2015

(86) PCT No.: PCT/US2015/033078
§ 371 (c)(1),
(2) Date: Dec. 2, 2016

(87) PCT Pub. No.: WO2015/187469
PCT Pub. Date: Dec. 10, 2015

(65) Prior Publication Data

US 2017/0145873 A1 May 25, 2017

Related U.S. Application Data

(60) Provisional application No. 62/008,017, filed on Jun. 5, 2014.

(51) Int. Cl.
*F01L 1/34* (2006.01)
*F01L 1/352* (2006.01)

(52) U.S. Cl.
CPC ..... *F01L 1/352* (2013.01); *F01L 2001/3522* (2013.01)

(58) Field of Classification Search
CPC ..... F01L 1/352; F01L 2001/3522
See application file for complete search history.

(56) References Cited

U.S. PATENT DOCUMENTS

| | | | |
|---|---|---|---|
| 5,680,837 | A | 10/1997 | Pierik |
| 2003/0145816 | A1 | 8/2003 | Lehmann |
| 2010/0064998 | A1 | 3/2010 | Hale et al. |

FOREIGN PATENT DOCUMENTS

| | | | |
|---|---|---|---|
| EP | 2006501 | A1 | 12/2008 |
| KR | 20120041442 | A | 5/2012 |

OTHER PUBLICATIONS

International Search Report for Application No. PCT/US2015/033078 dated Aug. 21, 2015, 3 pages.

*Primary Examiner* — Zelalem Eshete

(57) ABSTRACT

A cam phaser (30, 130, 230) dynamically adjusts a rotational relationship of a camshaft (32) of an internal combustion engine with respect to an engine crankshaft operably connected with a phaser sprocket (42, 142, 242). The cam phaser (30, 130, 230) can include a planetary gear assembly having a ring gear (34, 134, 234) driven by the phaser sprocket (42, 142, 242), a planetary gear carrier (36, 136, 236) connected to the camshaft (32), a sun gear (38, 138, 238), and at least one rotatable planetary gear (40, 140, 240). The cam phaser (30, 130, 230) can include a sprocket housing (44, 144, 244) connected with the phaser sprocket (42, 142, 242) and operable for connection with the ring gear (34, 134, 234), a cover plate (46, 146, 246) secured to the carrier (36, 136, 236), and a adapter (48) connected between the sun gear (38, 138, 238) and an electric motor (47) for changing an angular position of the sun gear (38, 138, 238) and adjustably varying a cam phase position of the camshaft (32) relative to the crankshaft.

14 Claims, 7 Drawing Sheets

ELECTRIC CAM PHASER WITH FIXED SUN PLANETARY

FIELD OF THE INVENTION

The invention relates to a planetary gear assembly for dynamically adjusting a phase angle of a camshaft with respect to an engine crankshaft to improve fuel efficiency of an internal combustion engine.

BACKGROUND

Electric cam phasers can be used in an internal combustion engine for varying the phase angle between a driven camshaft and a driving crankshaft of the associated engine in order to vary valve open and/or closing timing. Known electric cam phasers can include a magnetic clutch with a helical spline mechanism and two state cycloid gear reducing, which requires continuous power to maintain position of the camshaft. Known electric cam phasers can also include a brushless direct current (DC) motor driven at the speed of the cam to maintain position, and to change speed while spinning, constantly consuming power. Electric cam phasers have been disclosed in U.S. Pat. No. 6,971,352; U.S. Pat. No. 5,680,837; and U.S. Pat. No. 5,327,859.

SUMMARY

It can be desirable to provide an electric cam phaser with more cost efficient components compared to the brushless DC motor. A camshaft phase angle can be varied by adjusting an angular position of a sun gear of a planetary gear train. An electric cam phaser can include an epicyclic gear structure with a drive-side and output side ring gear in meshing engagement with planetary gears. The output side ring gear can have a number of teeth different from the drive-side ring gear, such that the position of the camshaft relative to the crankshaft can be adjusted by a central sun gear driven by an electric motor. The electric cam phaser can include an electric motor driven worm gear connected to adjust the angular position of the sun gear.

An electric cam phaser for dynamically adjusting an angular position of a camshaft of an internal combustion engine with respect to an engine crankshaft can include a phaser sprocket driven by an endless loop power transmission member connected to a drive sprocket mounted for rotation with the engine crankshaft. The electric cam phaser can include a planetary gear assembly having a ring gear driven by the phaser sprocket, a planetary gear carrier connected to the camshaft, and a sun gear. The phaser sprocket, planetary gear carrier, and sun gear can be rotatable about a common axis. The carrier can support at least one rotatable planetary gear operably engageable with the ring gear and the sun gear. The sun gear can drive the at least one rotatable planetary gear in rotation for relative movement of the carrier. Rotational movement of the carrier driven by the sun gear within the phaser sprocket can adjustably vary a cam phaser position of the camshaft relative to the crankshaft. The sun gear can be fixed for maintaining a cam phase position of the camshaft relative to the crankshaft and can be driven with an electric motor to provide an adjustable angular position for varying the cam phase position.

A simple planetary gear assembly can drive the camshaft at a ratio that when multiplied by the ratio between the drive sprocket operably driven by the crankshaft and the phaser sprocket results in an overall combined drive ratio of 0.5:1.

An electric motor can be arranged to rotationally drive the sun gear and thereby the carrier to achieve the desired cam phasing to advance or retard valve open and/or closing timing. At least one sensor can be provided to supply a feedback signal to a controller of the electric motor. The at least one sensor can sense a position of the phaser sprocket relative to the camshaft. An engine control unit can determine, if any cam phaser position adjustment is required, based on a signal from the at least one sensor. A adapter can be connected between the electric motor and the sun gear, such that the electric motor can drive the sun gear in rotational movement thereby changing an angular position of the carrier and camshaft relative to the ring gear and crankshaft.

A sprocket housing can be connected for rotation with the phaser sprocket. The sprocket housing can include a ring gear formed integrally on an inner diameter, such that the at least one planetary gear can engage teeth of the ring gear formed on the inner diameter of the sprocket housing. The sprocket housing can include a notched inner diameter engageable with a tabbed outer diameter of the ring gear for connecting the sprocket housing and the ring gear to one another for rotation in unison with one another. A cover plate can be secured to the carrier for enclosing the planetary gear assembly and preventing loss of lubricant during operation of the planetary gear assembly.

A method for assembling and for dynamically adjusting an angular position of a camshaft of an internal combustion engine with respect to an engine crankshaft is disclosed. A phaser sprocket can be driven by an endless loop power transmission member connected to a drive sprocket mounted for rotation with the engine crankshaft. The method can include assembling a planetary gear assembly having a planetary gear carrier mounted to the camshaft, a ring gear driven by the phaser sprocket, a sun gear rotatable on a common axis with the carrier, and at least one planetary gear supported by the carrier in meshing engagement between the sun gear and the ring gear. The sun gear can have an adjustable angular position for varying the phasing of the camshaft relative to the crankshaft. The method can further include connecting a sprocket housing with the phaser sprocket and securing a cover plate to the carrier enclosing the planetary gear assembly. The method can include forming the ring gear integrally on an inner diameter on the sprocket housing or forming a notched inner diameter on the sprocket housing, forming a complementary tabbed outer diameter on the ring gear, and inserting the tabbed outer diameter of the ring gear within the notched inner diameter of the sprocket housing for connecting the ring gear to the sprocket housing.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
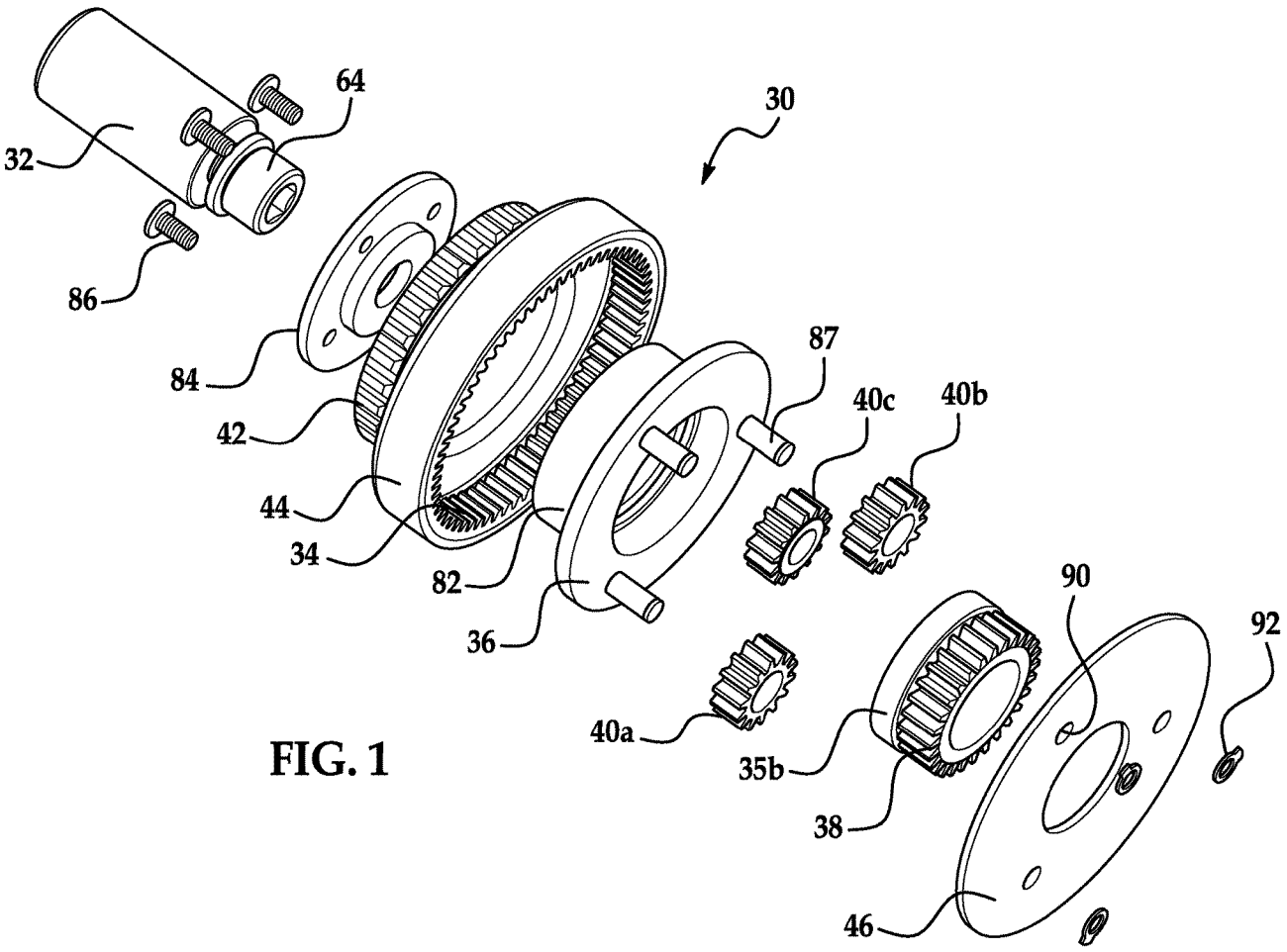
FIG. 1 is an exploded perspective view of an electric cam phaser illustrating a sprocket housing, a ring gear, and a phaser sprocket formed as a rotatable component and engageable with a cover plate for holding a planetary gear assembly within the sprocket housing.

Referring now to FIGS. 1-5C, an electric cam phaser 30, 130, 230 for controlling the timing of valve opening and/or closing through angular position of a camshaft 32 relative to a crankshaft is illustrated. The camshaft 32 can be driven in rotation by connection to a crankshaft of an internal combustion engine. The electric cam phaser 30, 130, 230 can dynamically adjust an angular position rotational relationship of the camshaft 32 with respect to the crankshaft. A phaser sprocket 42, 142, 242 can be driven by an endless loop power transmission member connected to a drive sprocket mounted for rotation with the engine crankshaft. The electric cam phaser 30, 130, 230 can include a planetary gear assembly having a ring gear 34, 134, 234 a planetary gear carrier 36, 136, 236, and a sun gear 38, 138, 238, all rotatable about a common axis. The carrier 36, 136, 236 can support at least one rotatable planetary gear 40, 140, 240 in meshing engagement between the ring gear 34, 134, 234 and the sun gear 38, 138, 238. The sun gear 38, 138, 238, the ring gear 34, 134, 234, and the at least one planetary gear 40, 140, 240 can have helical teeth, if desired. The phaser sprocket 42, 142, 242 can drive the ring gear 34, 134, 234. The sun gear 38, 138, 238 can be fixed for maintaining an angular cam phase position of the camshaft 32 relative to the crankshaft and can have an adjustable angular position for relatively changing the angular position rotational relationship of the camshaft 32 to thereby varying a phasing of the camshaft 32 relative to the crankshaft.

As illustrated in FIG. 1, the electric cam phaser 30 can include a sprocket housing 44 rotatable about a common axis for rotation with a planetary gear assembly. The sprocket housing 44 can be connected to a phaser sprocket 42 for rotation therewith. A ring gear 34 can form an integral part of the sprocket housing 44 for rotation therewith. The ring gear 34 can be integrally formed on an inner diameter of the sprocket housing 44. The ring gear 34 can be engageable with at least one rotatable planetary gear 40. The sprocket housing 44, phaser sprocket 42, and ring gear 34 can be manufactured and assembled as a single unitary monolithic component for engagement in the electric cam phaser 30. As illustrated in FIG. 1, the at least one rotatable planetary gear 40 can include a first, a second, and a third planetary gear 40*a*, 40*b*, 40*c*. A planetary gear carrier 36 can include a drive flange 82 to be connected through the sprocket housing 44 and the phaser sprocket 42 for assembly to a carrier adapter 84 with a plurality of screws 86, a center bolt 64, and a set screw 88, best seen in FIG. 2A, for attachment to the camshaft 32. The carrier adapter 84 can be connected for rotation with the cam shaft 32. The carrier adapter 84 can rotatable drive the camshaft 32 through the carrier adapter 84, center bolt 64, and set screw 88 connection. The carrier 36 can include a plurality of stub shafts 87 supporting the first, second, and third planetary gears 40*a*, 40*b*, 40*c* for rotation thereon. The plurality of planetary gears 40*a*, 40*b*, 40*c* are connected in intermeshing engagement with the ring gear 34 and the sun gear 38. The electric cam phaser 30 can include a cover plate 46 having a plurality of apertures 90 for attaching the cover plate 46 to the planetary gear carrier 36 in order to capture the planetary gears 40*a*, 40*b*, 40*c* on the plurality of stub shafts 87. The cover plate 46 can close an open end of the carrier 36 for enclosing the planetary gear assembly. By way of example and not limitation, the cover plate 46 can be secured to the carrier 36 with a plurality of retaining ring clips 92 secured to the outer ends of the plurality of stub shafts 87. As illustrated in the electric cam phaser 130 of FIG. 2, by way of example and not limitation, the cover plate 146 can be secured to the carrier 136 with a plurality of bolts 192 extending through the plurality of apertures defined by the cover plate 146.

Figure 2A:
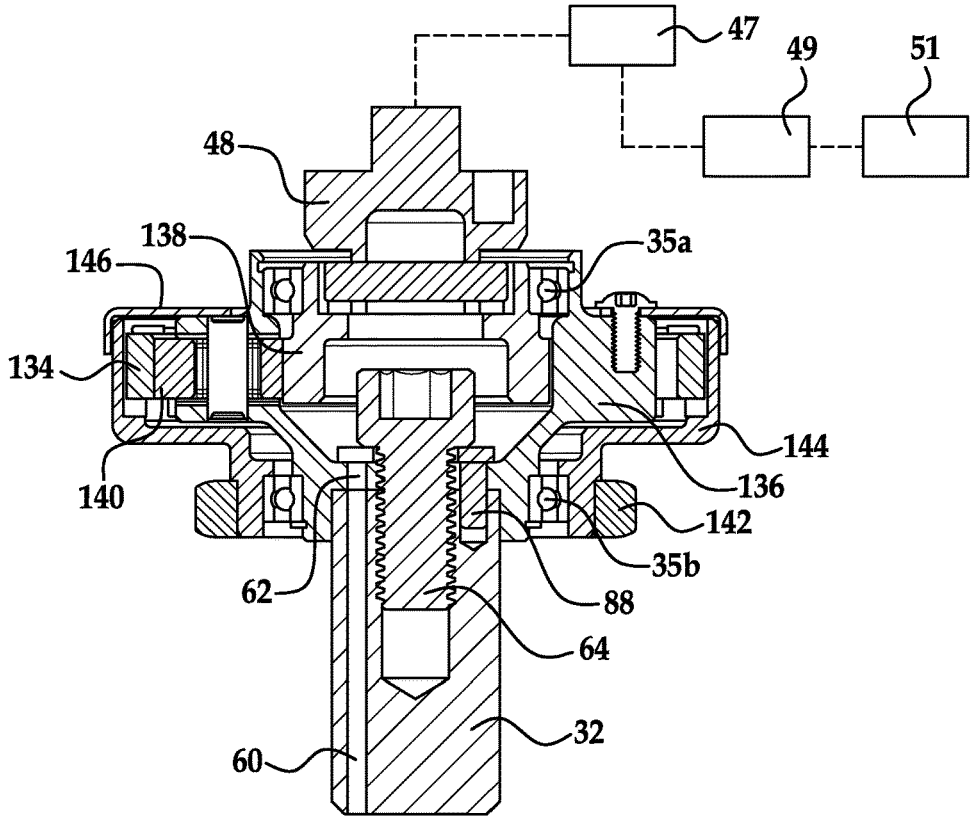
FIG. 2A is a sectional view of an electric cam phaser illustrating a sprocket housing and a phaser sprocket formed separately from a ring gear, a cover plate for holding a planetary gear assembly within the sprocket housing, and a adapter for connecting to a sun gear.
Figure 2C:
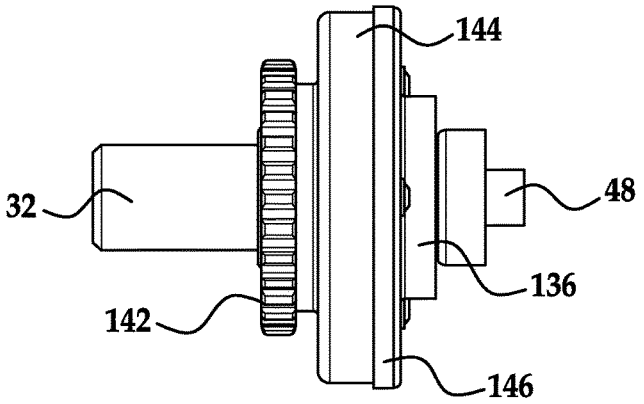
FIG. 2C is a plan view of the electric cam phaser shown in FIGS. 2A-2B depicting the phaser assembly connected between a camshaft and a adapter.
Figure 2B:
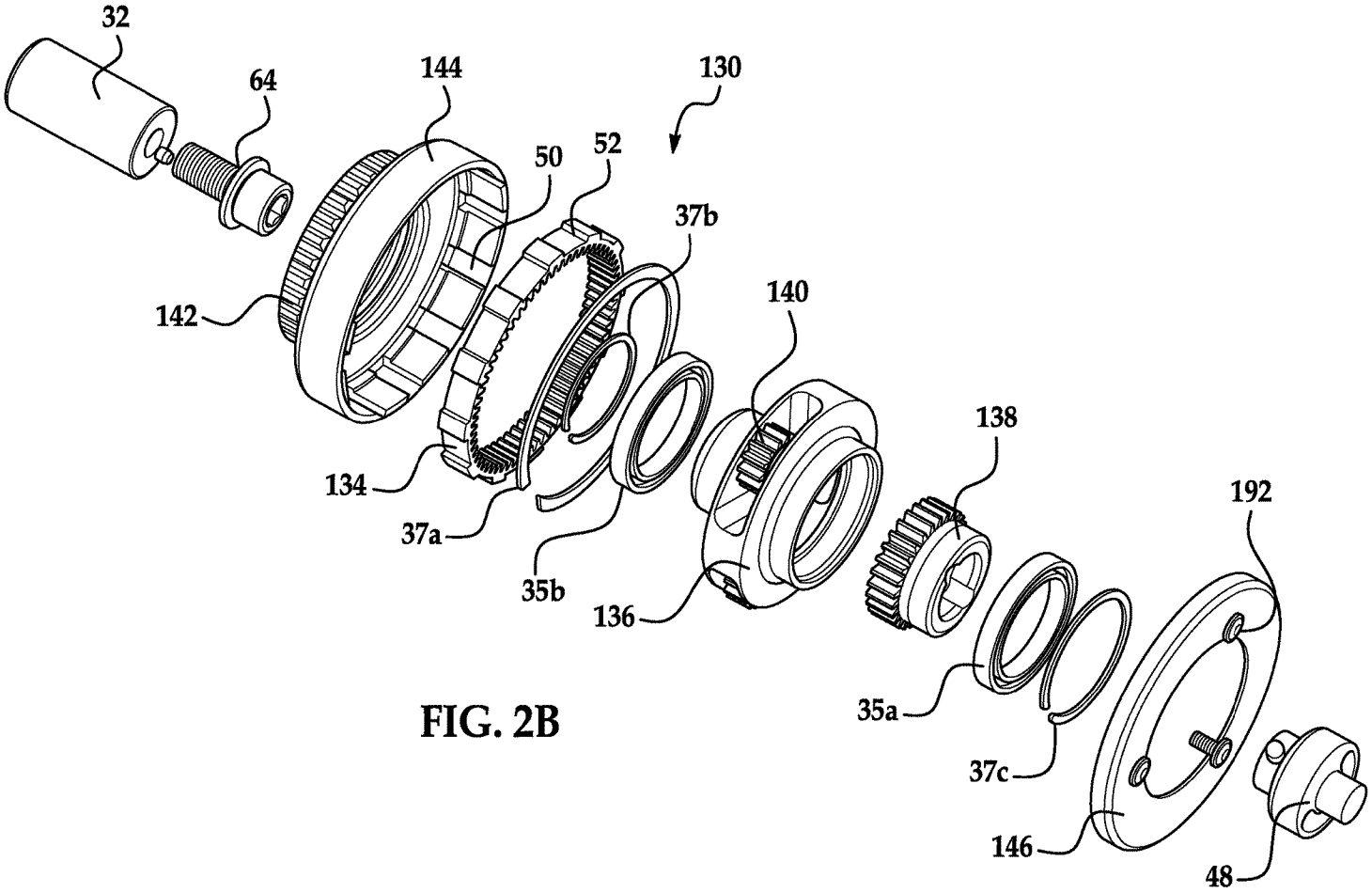
FIG. 2B is an exploded perspective view of the electric cam phaser shown in FIG. 2A.

As illustrated in 2A-5C, the electric cam phaser 130, 230 can include a center bolt 64 located along a common axis. The center bolt 64 and a set screw 88 can secure the carrier 136, 236 to the camshaft 32 by threadedly engaging with an end of the camshaft 32, while the center bolt 64 extends through the sun gear 138, 238, the carrier 136, 236, and the sprocket housing 144, 244. As illustrated in FIGS. 2A-2C, the sprocket housing 144 and the ring gear 134 can be separate components. The sprocket housing 144 can include a notched inner diameter 50 and the ring gear 134 can include a complementary tabbed outer diameter 52 to be engageable with the notched inner diameter 50 for connecting the sprocket housing 144 and the ring gear 134 to one another. The sprocket housing 144, phaser sprocket 142, and the ring gear 134 can rotate in unison as a single unitary monolithic component after assembly.

As further illustrated in FIGS. 2A-2C, the electric cam phaser 30, 130, 230 can include a adapter 48 connected to the sun gear 38, 138, 238. As illustrated in FIG. 2A, the adapter 48 can be connected to an electric motor 47. The sun gear 38, 138, 238 can be driven in rotational movement by the electric motor 47, thereby changing an angular position of the carrier 36, 136, 236 resulting in a cam phase position change of the camshaft 32 relative to the crankshaft. At least one sensor 49 can be provided to supply a feedback signal to an engine control unit or controller 51 to indicate a position of crankshaft relative to the camshaft 24 to determine if any cam phase position adjustment through the sun gear 38, 138, 238 is required. If a cam phase position adjustment is required, the electric motor 47 can be driven by the controller to move the cam phase position in either rotational direction, advancing or retarding, toward the desired location through rotational movement of the sun gear 38, 138, 238, thereby causing relative rotation of the at least one planetary gear 40, 140, 240 driving the of the carrier 36, 136, 236 and connected camshaft 32. In operation, the crankshaft of the internal combustion engine can rotate for driving the camshaft 32 through the sprocket 42, 142, 242 and the electric cam phaser 30, 130, 230 can change the relative angular position of the camshaft 32 relative to the crankshaft through rotation of the sun gear 38, 138, 238. The ratio of the number of teeth located on the sprockets and the ration of the gears of the planetary gear assembly are chosen, such that, when the sun gear 38, 138, 238 is held stationary or in a fixed position, the at least one planetary gear 40, 140, 240 can rotate around the sun gear 38, 138, 238 and relatively move the carrier 36, 136, 236 such that the camshaft 32 can be normally driven at one half crankshaft speed in a fixed phase relationship, as is conventional in a four stroke cycle engine. The electric motor 47 can be driven in forward or reverse directions to either advance or retard the camshaft phase angle, controlling the opening and closing of associated internal combustion engine valves with respect to the timing of the crankshaft. In order to change the phase relationship of the camshaft 32 with respect to the crankshaft while the engine is operating, the electric motor 47 can be rotated by the controller 51 in a desired direction thereby changing the angular position of the camshaft through rotation of the sun gear 38, 138, 238.

Figure 5A:
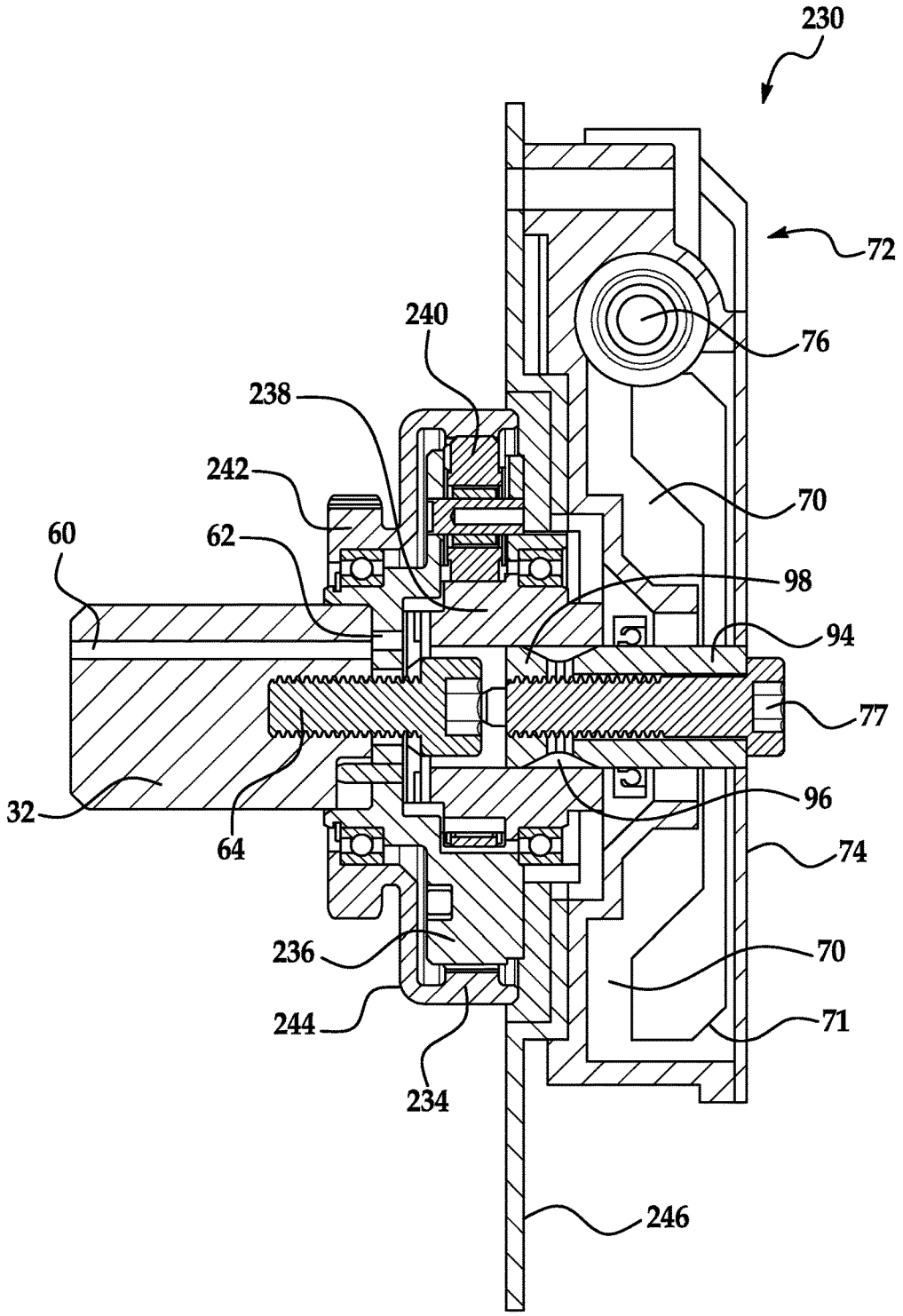
FIG. 5A is a cross sectional view of an electric cam phaser illustrating a drive gear assembly including a worm gear connected to a shaft driven by an electric motor, a pinion gear engageable between the worm gear and a sun gear, a stationary housing for receiving the worm gear and the pinion gear, and a housing cover for closing the drive gear assembly.
Figure 5B:
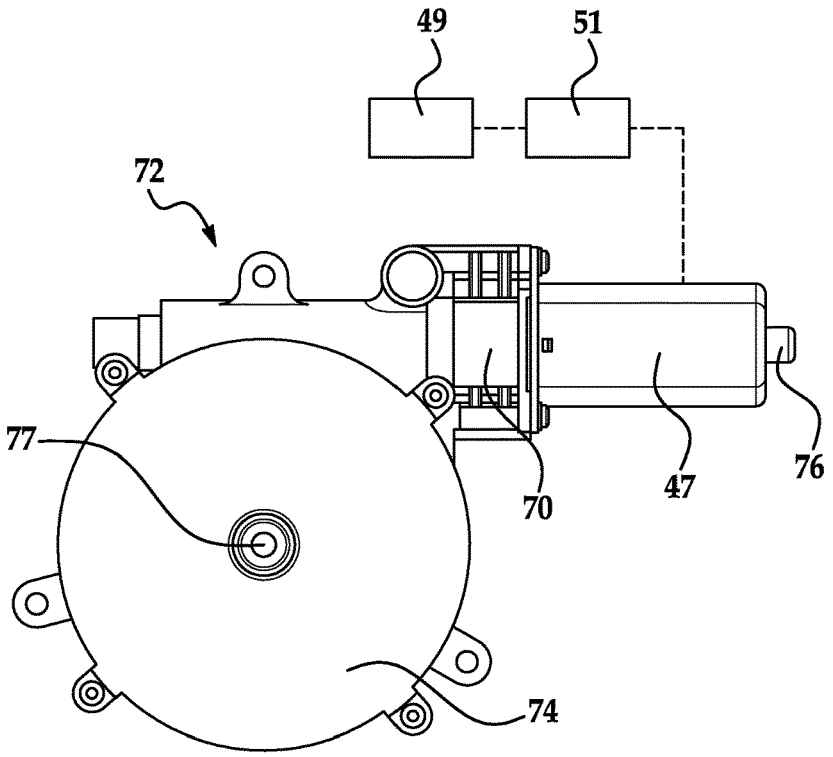
FIG. 5B is a side view of the electric cam phaser shown in FIG. 5A illustrating the housing cover, electric motor, and worm gear/pinion gear housing.
Figure 5C:
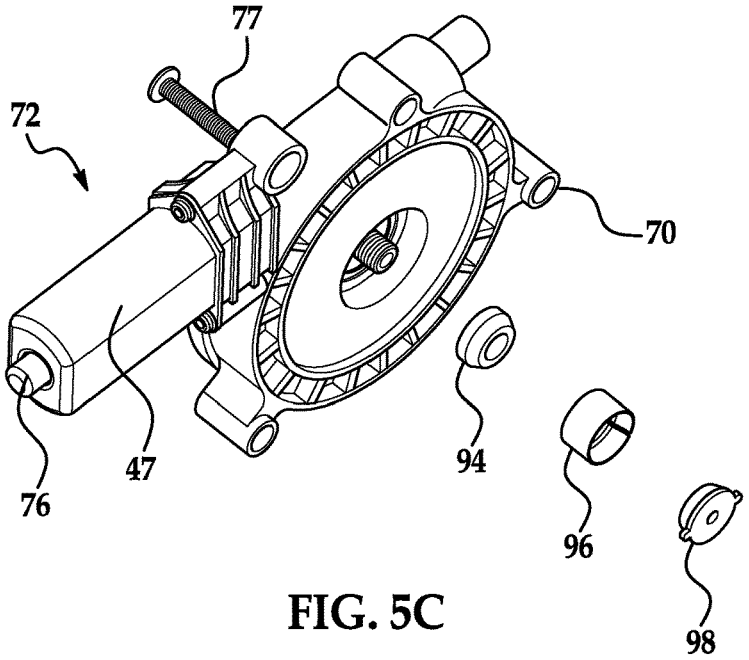
FIG. 5C is an exploded perspective view of the electric cam phaser shown in FIGS. 5A-5B illustrating a tensioning bolt and bushings for connecting the drive gear assembly to the planetary gear assembly.

As illustrated in the electric cam phaser 230 of FIGS. 5A-C, a cover plate 246 can be mounted to a drive gear assembly 72 including a stationary housing 70, a worm gear 76, an actuator shaft 78 driven by the engine, and a pinion gear 71 engageable between the worm gear 76 and the sun gear 238. The stationary housing 70 encloses a worm gear 76 mounted on bearings (not shown) for rotation on a longitudinal axis. As illustrated in FIG. 5B, the actuator shaft 78 can be connected to the electric motor 47 for driving the worm gear 76. The worm gear 76 can engage the pinion gear 71 which can be coaxial with the camshaft 32 to drive the sun gear 238 in rotation in response to rotation of the electric motor 47. The drive gear assembly 72 can include a cover 74 bolted to the stationary housing 70 for closing the drive gear assembly 72 from the engine compartment and a tensioning bolt 77 for securing the pinion gear 71 to the sun gear 238 of the drive gear assembly 72. The tensioning bolt 77 can extend through the cover 74 and stationary housing 70 to threadingly engage with a keyed bushing 98 for connecting the pinion gear 71 for rotation as a single unitary monolithic member with the sun gear 238. As illustrated in FIG. 5C, the drive gear assembly 72 can further include a keyed bushing 98 with radially outwardly extending keys for insertion within corresponding complementary keyways formed on an interior surface of the sun gear 238 for connecting the sun gear 238 to the pinion gear 71, a wedged shaped bushing 94 for connecting the pinion gear 71 with the sun gear 238, and a split ring 96 interposed between the sun gear bushing 98 and the wedge shaped bushing 94 for radial expansion in response to compression between the two bushings 96, 98 when bolt 77 is tightened. The tensioning bolt 77 can extend through the bushing 94 and the split ring 96 to threadingly engage with the keyed bushing 98 to compress and radially expand the split ring 96 interposed between the wedged bushing 94 and keyed bushing 98 for connecting the pinion gear 71 to the sun gear 238 of the drive gear assembly 72. In operation, rotation of the electric motor 47 can rotate the worm gear 76 and the associated pinion gear 71 for changing the rotational position of the sun gear 238 in the planetary gear assembly. The change in rotational position causes relative rotation of the carrier 236 within the phaser housing 34, thereby rotating the camshaft 32 and changing a phase of the camshaft 32 with respect to the phaser sprocket 242 and the crankshaft. It should be recognized that the drive gear assembly 72 can be configured for use with other planetary gear assemblies, where any one of a planetary gear carrier and a ring gear can be used to vary the phasing, while the sun gear and other planetary gear part act as input and output elements.

Figure 3A:
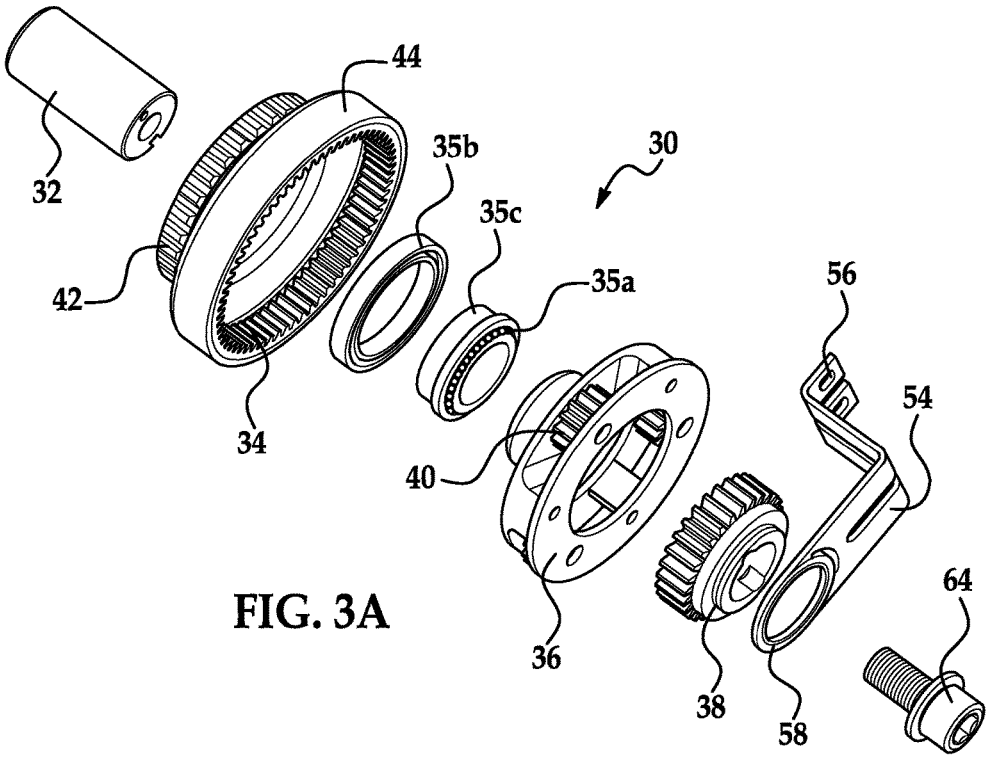
FIG. 3A is an exploded perspective view of an electric cam phaser illustrating a timing bracket connected to a sun gear for limiting angular rotation of the sun gear between first and second end limits of travel.
Figure 3B:
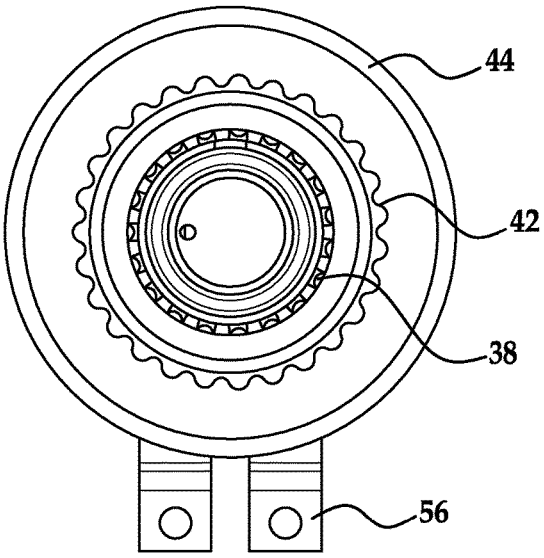
FIG. 3B is an end view of the electric cam phaser shown in FIG. 3A.

As illustrated in FIGS. 3A-3B, the electric cam phaser 30 can further include a timing bracket 54. The timing bracket 54 can include a first end 56 fixedly mounted to structure within the compartment enclosing the internal combustion engine and a second end 58 having a cylindrical aperture for receiving a portion of the sun gear 38. The timing bracket 54 can be connected to the sun gear 38 and operable for limiting rotation of the sun gear 38. It is contemplated the electric cam phaser 30 can include various configurations of bearings and washers as recognized by one skilled in the art without departing from the scope of disclosed invention. By way of example and not limitation, the electric cam phaser 30 can include a first bearing 35*a* for supporting the sun gear 38 for rotation with respect to the planetary gear carrier 36, a second bearing 35*b* for supporting the planetary gear carrier for rotation with respect to the sprocket housing 44, and a bearing hub 35*c* for supporting the sun gear 38 for rotation with respect to a slot and pin limiting a range of travel between first and second angular end limits.

It should be recognized that the bearings can include be provided in a bushing or ball type, if desired. It can be desirable to provide bearings for reducing the axial length of the electric cam phaser for minimum packaging. As illustrated in FIG. 1, the sun gear 38 can be piloted to the carrier 36 by a first bearing (not shown). As illustrated in FIGS. 2A-4B, in addition to at least one bearing 35*b* for supporting the planetary gear carrier for rotation with respect to the sprocket housing 144 of the planetary gear assembly, the electric cam phaser 130 can include at least one retaining ring 37*a*, 37*b*, 37*c* for holding the various components of the planetary gear assembly in position with respect to one another. The electric cam phaser 130 can include retaining rings 37*a*, 37*b*, 37*c* associated with the ring gear 134, the second bearing 35*b*, and the first bearing 35*a*, respectively.

Figure 4A:
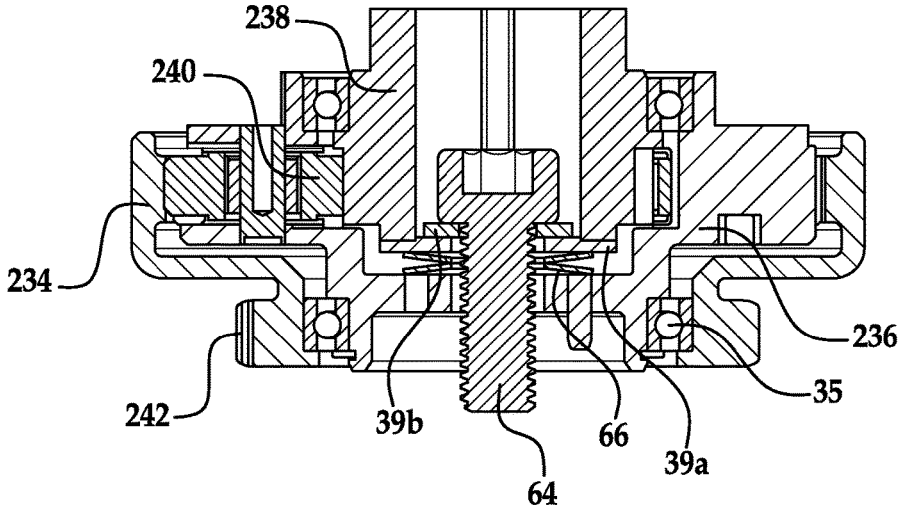
FIG. 4A is a cross sectional view of an electric cam phaser illustrating belleville washers operable for biasing a sun gear against a carrier to prevent rotation of the sun gear during packaging and transportation of the electric cam phaser.
Figure 4B:
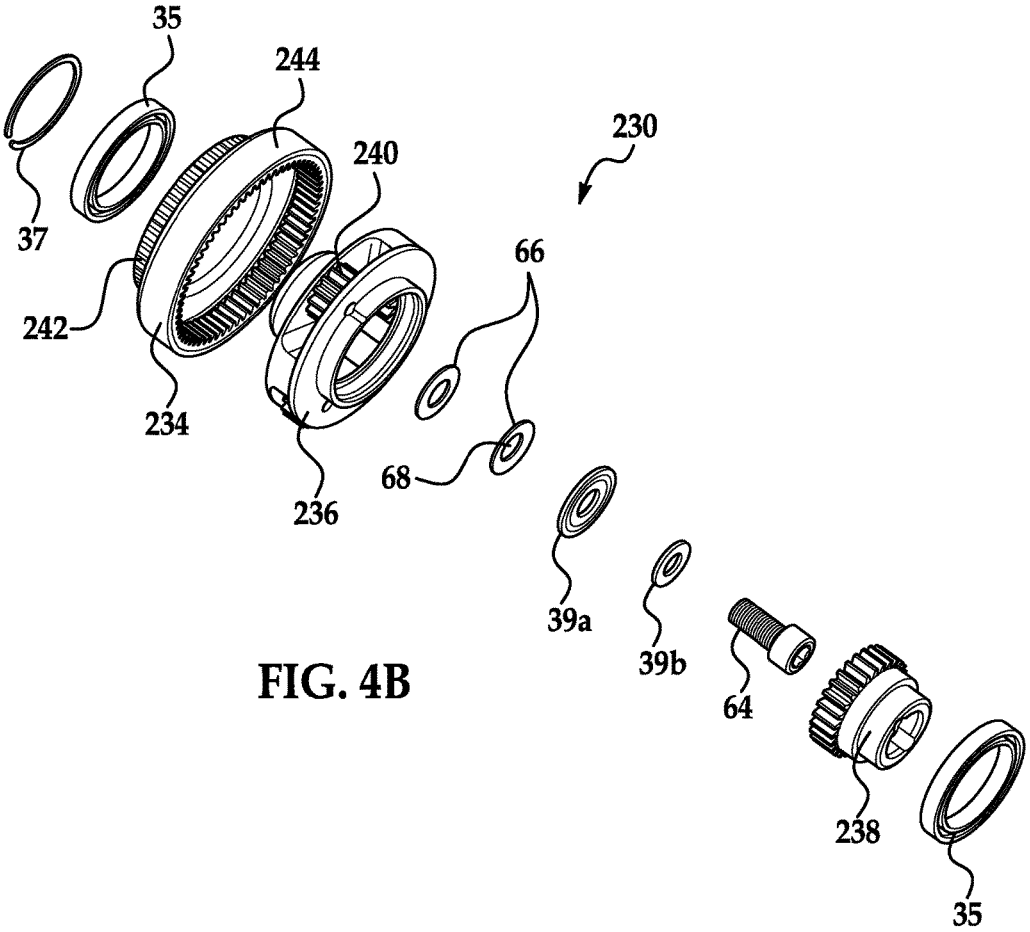
FIG. 4B is an exploded perspective view of the electric cam phaser shown in FIG. 4A.

As illustrated in FIG. 4A-4B, the electric cam phaser 30, 130, 230 can additionally include at least one serrated washer 39*a*, a belleville washer 66, and at least one flat washer 39*b* for pressing the serrated washer 39*a* against the sun gear 238 with the belleville washers 66 interposed between the serrated washer 39*a* and the carrier 236 to prevent rotation until the carrier 236 has been connected to the camshaft. When the carrier is connected to the camshaft, the center bolt 64 compresses the belleville washers 66 between the serrated washer 39*a* and the carrier 236 allowing the sun gear 238 to be released and rotate freely. As illustrated in FIGS. 4A-4B, the electric cam phaser 230 can include at least one belleville washer 66 located along the common axis and interposed between the sun gear 238 and the carrier 236. The at least one belleville washer 66 can include a central opening 68 for receiving the center bolt 64 when the electric cam phaser 230 is assembled. The at least one belleville washer 66 normally biases the serrated washer 39*a* against the sun gear 238 and holds the sun gear 238 against rotation with respect to the carrier 236. The normally biased position can be desirable for packaging and assembly of the electric cam phaser 230. The normally biased position can be defined by the belleville washer 66 biasing the sun gear against the carrier 236 to prevent rotation of the sun gear 238. When the electric cam phaser 230 is assembled and the center bolt 64 engages through the belleville washer 66 for threaded attachment to the camshaft, the belleville washer 66 can be compressed during tightening of the center bolt 64 releasing the sun gear 238 enabling the sun gear 238 to freely rotate.

As illustrated in FIGS. 2A and 5A, by way of example and not limitation, the electric cam phaser 30, 130, 230 can include a lubrication system for lubricating the rotatable components of the planetary gear assembly. The lubrication system can include fluid communication from a source of pressurized fluid through a first aperture 60 defined by the camshaft 32 toward the carrier 36, 136, 236. The carrier 36, 136, 236 can have a second aperture 62 for fluid communication with the electric cam phaser 30, 130, 230. The second aperture 62 can have a smaller flow area with respect to the first aperture 60. The smaller flow area allows the first aperture 60 in the camshaft 32 to be manufactured with a larger diameter.

A method for assembling and for dynamically adjusting a rotational relationship of a camshaft 32 of an internal combustion engine with respect to an engine crankshaft is disclosed. A phaser sprocket 42, 142, 242 can be operably driven by the crankshaft. The method can include assembling a planetary gear assembly having a ring gear 34, 134, 234 driven by the phaser sprocket 42, 142, 242, a planetary gear carrier 36, 136, 236 connected to the camshaft 32, and a sun gear 38, 138, 238, such that all are rotatable about a common axis. The carrier 36, 136, 236 can supporting at least one rotatable planetary gear 40, 140, 240 in meshing engagement between the ring gear 34, 134, 234 and the sun gear 38, 138, 238 and the sun gear 38, 138, 238 can be fixed for maintaining a cam phase position of the camshaft 32 relative to the crankshaft and having an adjustable angular position for varying the cam phase position. The method can include forming a sprocket housing 44, 144, 244 connected for rotation with the phaser sprocket 42, 142, 242 and operable for connecting the phaser sprocket 42, 142, 242 and the ring gear 34, 134, 234 for uniform rotation. The method can further include inserting a rotation prevention mechanism along the common axis. The rotation prevention mechanism can include at least one serrated washer 39*a* and a belleville washer 66 interposed between the at least one serrated washer 39*a* and the carrier 236. The at least one serrated washer 39*a* can be normally biased against the sun gear 238 by the belleville washer 66 preventing rotation of the sun gear 238 when the carrier 236 is disconnected from the camshaft 32, such as when the electric cam phaser 30, 130, 230 is packaged for transportation. The belleville washer 66 can be compressible and allow rotation of the sun gear 238 when the carrier 236 is connected to the camshaft 32 during operation of the electric cam phaser 30, 130, 230. The method can further include inserting a timing bracket 54 connected to the sun gear 38, 138, 238 and operable for limiting angular rotation of the sun gear 38 between first and second end limits of travel.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In an electric cam phaser (30, 130, 230) for dynamically adjusting a rotational relationship of a camshaft (32) of an internal combustion engine with respect to an engine crankshaft, the improvement comprising:

a phaser sprocket (42, 142, 242) to be operably driven by the crankshaft;

a planetary gear assembly having a ring gear (34, 134, 234) driven by the phaser sprocket (42, 142, 242), a planetary gear carrier (36, 136, 236) connected to the camshaft (32), and a sun gear (38, 138, 238), all rotatable about a common axis, the carrier (36, 136, 236) supporting at least one rotatable planetary gear (40, 140, 240) in meshing engagement between the ring gear (34, 134, 234) and the sun gear (38, 138, 238);

a sprocket housing (44, 144, 244) connected for rotation with the phaser sprocket (42, 142, 242), the sprocket housing (44, 144, 244) connecting the phaser sprocket (42, 142, 242) and the ring gear (34, 134, 234) for rotation; and a timing bracket (54) connected to the sun gear (38, 138, 238) and operable for limiting angular rotation of the sun gear (38) between first and second end limits of travel.

2. The improvement of claim 1, further comprising:

a cover plate (46, 146, 246) rotatable about the common axis and secured to the carrier (36, 136, 236) and closing an open end of the carrier (36, 136, 236), the cover plate (46, 146, 246) enclosing the planetary gear assembly.

3. The improvement of claim 1, further comprising:

an adapter (48) connected between the sun gear (38, 138, 238) and an electric motor (47), the sun gear (38, 138, 238) driven in rotational movement by the electric motor (47) for changing an angular position of the sun gear (38, 138, 238), the sun gear (38, 138, 238) driving the at least one planetary gear (40, 140, 240) thereby changing a rotational position of the carrier (36, 136, 236) and adjustably varying a cam phase position of the camshaft (32) relative to the crankshaft.

4. The improvement of claim 1, wherein the ring gear (34, 234) is formed integrally on a splined inner diameter of the sprocket housing (44, 244).

5. The improvement of claim 1, further comprising:

a rotation prevention mechanism including at least one serrated washer (39*a*) and a belleville washer (66) interposed between the at least one serrated washer (39*a*) and the carrier (236), the at least one serrated washer (39*a*) normally biased against the sun gear (238) by the belleville washer (66) preventing rotation of the sun gear (238) when the carrier (236) is disconnected from the camshaft (32), the belleville washer (66) compressible and allowing rotation of the sun gear (238) when the carrier (236) is connected to the camshaft (32).

6. The improvement of claim 1, further comprising:

a drive gear assembly (72) operable for driving the sun gear (238) including a worm gear (76) operably driven by an electric motor (47) and driving a pinion gear (71), a wedged shaped bushing (94) connected to the pinion gear (71), a keyed bushing (98) connected to the sun gear (238), a split ring (96) interposed between the keyed bushing (98) and the wedge shaped bushing (94), and a tensioning bolt (77), the split ring (96) operable for radial expansion when the tensioning bolt (77) extends through the wedged shaped bushing (94) and the split ring (96) to threadedly engage the keyed bushing (98) connecting the sun gear (238) and the pinion gear (71).

7. In an electric cam phaser (30, 130, 230) for dynamically adjusting a rotational relationship of a camshaft (32) of an internal combustion engine with respect to an engine crankshaft, the improvement comprising:

a phaser sprocket (42, 142, 242) to be operably driven by the crankshaft;

a planetary gear assembly having a ring gear (34, 134, 234) driven by the phaser sprocket (42, 142, 242), a planetary gear carrier (36, 136, 236) connected to the camshaft (32), and a sun gear (38, 138, 238), all rotatable about a common axis, the carrier (36, 136, 236) supporting at least one rotatable planetary gear (40, 140, 240) in meshing engagement between the ring gear (34, 134, 234) and the sun gear (38, 138, 238), the sun gear (38, 138, 238) being stationary for maintaining a cam phase position of the camshaft (32) relative to the crankshaft and being driven in rotation to different adjustable angular positions for varying the cam phase position;

a sprocket housing (44, 144, 244) connected for rotation with the phaser sprocket (42, 142, 242), the sprocket housing (44, 144, 244) operable for connecting the phaser sprocket (42, 142, 242) and the ring gear (34, 134, 234) for rotation; and a rotation prevention mechanism including at least one serrated washer (39*a*) and a belleville washer (66) interposed between the at least one serrated washer (39*a*) and the carrier (236), the at least one serrated washer (39*a*) normally biased against the sun gear (238) by the belleville washer (66) preventing rotation of the sun gear (238) when the carrier (236) is disconnected from the camshaft (32), the belleville washer (66) compressible and allowing rotation of the sun gear (238) when the carrier (236) is connected to the camshaft (32).

8. The improvement of claim 7, further comprising:

a timing bracket (54) connected to the sun gear (38, 138, 238) and operable for limiting angular rotation of the sun gear (38) between first and second end limits of travel.

9. The improvement of claim 7, further comprising:

an adapter (48) connected between the sun gear (38, 138, 238) and an electric motor (47), the sun gear (38, 138, 238) driven in rotational movement by the electric motor (47) for changing an angular position of the sun gear (38, 138, 238), the sun gear (38, 138, 238) driving the at least one planetary gear (40, 140, 240) thereby changing a rotational position of the carrier (36, 136, 236) and adjustably varying a cam phase position of the camshaft (32) relative to the crankshaft.

10. The improvement of claim 7, further comprising:

a cover plate (46, 146, 246) rotatable about the common axis and secured to the carrier (36, 136, 236) and closing an open end of the carrier (36, 136, 236), the cover plate (46, 146, 246) enclosing the planetary gear assembly.

11. The improvement of claim 7, further comprising:

a drive gear assembly (72) operable for driving the sun gear (238) including a worm gear (76) operably driven by an electric motor (47) and driving a pinion gear (71), a wedged shaped bushing (94) connected to the pinion gear (71), a keyed bushing (98) connected to the sun gear (238), a split ring (96) interposed between the keyed bushing (98) and the wedge shaped bushing (94), and a tensioning bolt (77), the split ring (96) operable for radial expansion when the tensioning bolt (77) extends through the wedged shaped bushing (94) and the split ring (96) to threadedly engage the keyed bushing (98) connecting the sun gear (238) and the pinion gear (71).

12. In an electric cam phaser (30, 130, 230) for dynamically adjusting a rotational relationship of a camshaft (32) of an internal combustion engine with respect to an engine crankshaft, the improvement comprising:

a phaser sprocket (42, 142, 242) to be operably driven by the crankshaft;

a planetary gear assembly having a ring gear (34, 134, 234) driven by the phaser sprocket (42, 142, 242), a planetary gear carrier (36, 136, 236) connected to the camshaft (32), and a sun gear (38, 138, 238), all rotatable about a common axis, the carrier (36, 136, 236) supporting at least one rotatable planetary gear (40, 140, 240) in meshing engagement between the ring gear (34, 134, 234) and the sun gear (38, 138, 238), the sun gear (38, 138, 238) being stationary for maintaining a cam phase position of the camshaft (32) relative to the crankshaft and being driven in rotation to different adjustable angular positions for varying the cam phase position;

a sprocket housing (44, 144, 244) connected for rotation with the phaser sprocket (42, 142, 242), the sprocket housing (44, 144, 244) operable for connecting the phaser sprocket (42, 142, 242) and the ring gear (34, 134, 234) for uniform rotation; and a timing bracket (54) connected to the sun gear (38, 138, 238) and operable for limiting angular rotation of the sun gear (38) between first and second end limits of travel.

13. The improvement of claim 12, further comprising:

a rotation prevention mechanism including at least one serrated washer (39*a*) and a belleville washer (66) interposed between the at least one serrated washer (39*a*) and the carrier (236), the at least one serrated washer (39*a*) normally biased against the sun gear (238) by the belleville washer (66) preventing rotation of the sun gear (238) when the carrier (236) is disconnected from the camshaft (32), the belleville washer (66) compressible and allowing rotation of the sun gear (238) when the carrier (236) is connected to the camshaft (32).

14. The improvement of claim 12, further comprising:

an adapter (48) connected between the sun gear (38, 138, 238) and an electric motor (47), the sun gear (38, 138, 238) driven in rotational movement by the electric motor (47) for changing an angular position of the sun gear (38, 138, 238), the sun gear (38, 138, 238) driving the at least one planetary gear (40, 140, 240) thereby changing a rotational position of the carrier (36, 136, 236) and adjustably varying a cam phase position of the camshaft (32) relative to the crankshaft.

* * * * *